US009903027B2

(12) United States Patent
Manders et al.

(10) Patent No.: US 9,903,027 B2
(45) Date of Patent: Feb. 27, 2018

(54) PROCESS FOR PRODUCING CHLORINE, CAUSTIC SODA, AND HYDROGEN

(75) Inventors: Antonius Jacobus Gerardus Manders, Huissen (NL); Jacoba Cornelia Petronella Adriana Oonincx, Arnhem (NL); Sami Petteri Pelkonen, Dortmund (DE); Massimo Giosafatte Borghesi, Milan (IT)

(73) Assignee: THYSSENKRUPP UHDE CHLORINE ENGINEERS (ITALIA) S.R., Milan (IT)

( * ) Notice: Subject to any disclaimer, the term of this patent is extended or adjusted under 35 U.S.C. 154(b) by 1648 days.

(21) Appl. No.: 13/133,912

(22) PCT Filed: Dec. 14, 2009

(86) PCT No.: PCT/EP2009/067016

§ 371 (c)(1),
(2), (4) Date: Sep. 1, 2011

(87) PCT Pub. No.: WO2010/069896

PCT Pub. Date: Jun. 24, 2010

(65) Prior Publication Data

US 2011/0303549 A1 Dec. 15, 2011

Related U.S. Application Data

(60) Provisional application No. 61/145,348, filed on Jan. 16, 2009.

(30) Foreign Application Priority Data

Dec. 17, 2008 (EP) ..... 08171947

(51) Int. Cl.

| | |
|---|---|
| ***C25B 1/46*** | (2006.01) |
| ***C25B 15/02*** | (2006.01) |
| ***C25B 15/08*** | (2006.01) |

(52) U.S. Cl.
CPC ..... *C25B 1/46* (2013.01); *C25B 15/02* (2013.01); *C25B 15/08* (2013.01)

(58) Field of Classification Search
CPC .... C25B 1/26; C25B 1/34; C25B 1/46; C25B 15/08; C25B 15/02
(Continued)

(56) References Cited

U.S. PATENT DOCUMENTS

| | | | |
|---|---|---|---|
| 3,390,065 | A | 6/1968 | Cooper |
| 3,974,051 | A | 8/1976 | Elliott et al. |

(Continued)

FOREIGN PATENT DOCUMENTS

| | | | |
|---|---|---|---|
| EP | 1 766 104 | B1 | 11/2007 |
| EP | 1 953 272 | A | 8/2008 |

(Continued)

OTHER PUBLICATIONS

Third party observations dated Sep. 6, 2011 issued for EP 09771555.1, 9 pages.

(Continued)

*Primary Examiner* — Arun S Phasge
(74) *Attorney, Agent, or Firm* — McDonnell Boehnen Hulbert & Berghoff LLP

(57) ABSTRACT

The invention provides a process for producing chlorine, alkaline metal hydroxide, and hydrogen which comprises the following steps: (a) preparing a brine by dissolving an alkaline metal chloride source in water; (b) removing alkaline precipitates from the brine prepared in step (a) in the presence of hydrogen peroxide by means of a filter of active carbon, and recovering the resulting brine; (c) subjecting at least part of the resulting brine as obtained in step (b) to an ion-exchange step; (d) subjecting at least part of the brine as obtained in step (c) to a membrane electrolysis step; (e) recovering at least part of the chlorine, alkaline metal
(Continued)

hydroxide, hydrogen, and brine as obtained in step (d); (f) subjecting at least part of the brine as recovered in step (e) to a dechlorination step; and (g) recycling at least part of the dechlorinated brine obtained in step (f) to step (a).

18 Claims, 1 Drawing Sheet

(58) Field of Classification Search
USPC ..... 205/536
See application file for complete search history.

(56) References Cited

U.S. PATENT DOCUMENTS

| | | | | |
|---|---|---|---|---|
| 3,986,951 | A | 10/1976 | Fremont | |
| 4,067,793 | A | 1/1978 | Piras et al. | |
| 4,190,505 | A | 2/1980 | Ogawa et al. | |
| 4,242,185 | A | 12/1980 | McRae | |
| 4,272,338 | A | 6/1981 | Lynch et al. | |
| 4,308,123 | A | 12/1981 | Lynn | |
| 4,336,115 | A | 6/1982 | Selby, III et al. | |
| 4,470,891 | A * | 9/1984 | Moore et al. | 205/536 |
| 4,483,754 | A | 11/1984 | Shiroki | |
| 4,836,903 | A | 6/1989 | Cawlfield | |
| 5,616,234 | A | 4/1997 | Rhees et al. | |
| 5,688,385 | A | 11/1997 | Rhees et al. | |
| 6,591,199 | B2 | 7/2003 | Tremblay et al. | |
| 7,972,493 | B2 * | 7/2011 | Davis et al. | 205/536 |
| 2007/0251831 | A1 | 11/2007 | Kaczur et al. | |
| 2008/0053839 | A1 | 3/2008 | Mentsches et al. | |

FOREIGN PATENT DOCUMENTS

| | | | |
|---|---|---|---|
| JP | 53-12919 | A | 2/1978 |
| JP | 53-123396 | A | 10/1978 |
| JP | 54-16396 | A | 2/1979 |
| JP | 55-91991 | A | 7/1980 |
| JP | 6-10177 | A | 1/1994 |
| JP | 6-10178 | A | 1/1994 |
| JP | 6-10180 | A | 1/1994 |
| JP | 2001-181877 | A | 7/2001 |
| RU | 2315132 | | 1/2008 |
| SU | 327784 | | 11/1972 |
| SU | 603403 | A1 | 4/1978 |
| SU | 1030424 | A | 7/1983 |
| WO | 01/063011 | A1 | 8/2001 |
| WO | 09/017593 | A2 | 2/2009 |

OTHER PUBLICATIONS

Hayden, Richard A., et al., "Fundamentals of Catalytic Activated Carbons", http://www.calgoncarbon.com/documents/FundamentalsofCAC.pdf.

Bommaraju, Tilak V., et al., "Brine Electrolysis", Electrochemistry Encyclopedia, http://electrochem.cwru.edu/encycl/art-b01-brine.htm, printed on Apr. 10, 2011.

Krishna, Vamsi, "Waste Treatment From Chlor-Alkali Industry", Power Point Presentation, http://google.com/#hl=en&xhr=t&q=vamsi(child_sem-2).ppt&cp=22&pq=removal%20of%20chlorine%20brine%20using%20hydrogen%20peroxide&pf=p=&sclient=psy&source=hp&aq=f&aqi=&aql=&oq=vamsi(child-sem-2).ppt&pbx=1&bav=on.2.or.r_pw.&fp=bc73d05e1fb2eced&biw=1031&bih=558.

European Commission, The IPPC Directive, http://ec.europa.eu/environment/air/pollutants/stationary/ippc/index.htm.

Moorhouse, John, Modern Chlor-Alkali Technology, vol. 8, p. 188.

Stemick et al., "New technology of production of chlorine bleach solution with chlorine-membrane electrolysis", BBR, Wasser, Kanal- & Rohrleitungsbau, 2001, 52(10), 35-37.

Akzo Nobel, "Electrolysis of brine", Research Disclosure, Aug. 2000, vol. 436, p. 1408.

Liederbach et al., "Onsite chlorine production: is convenience worth the cost?", Pulp & Paper, Nov. 1983, 58-61.

Reference Document on Best Available Techniques in the Chlor-Alkali Manufacturing Industry, Integrated Pollution Prevention and Control (IPPC), Dec. 2001, 1-162.

* cited by examiner

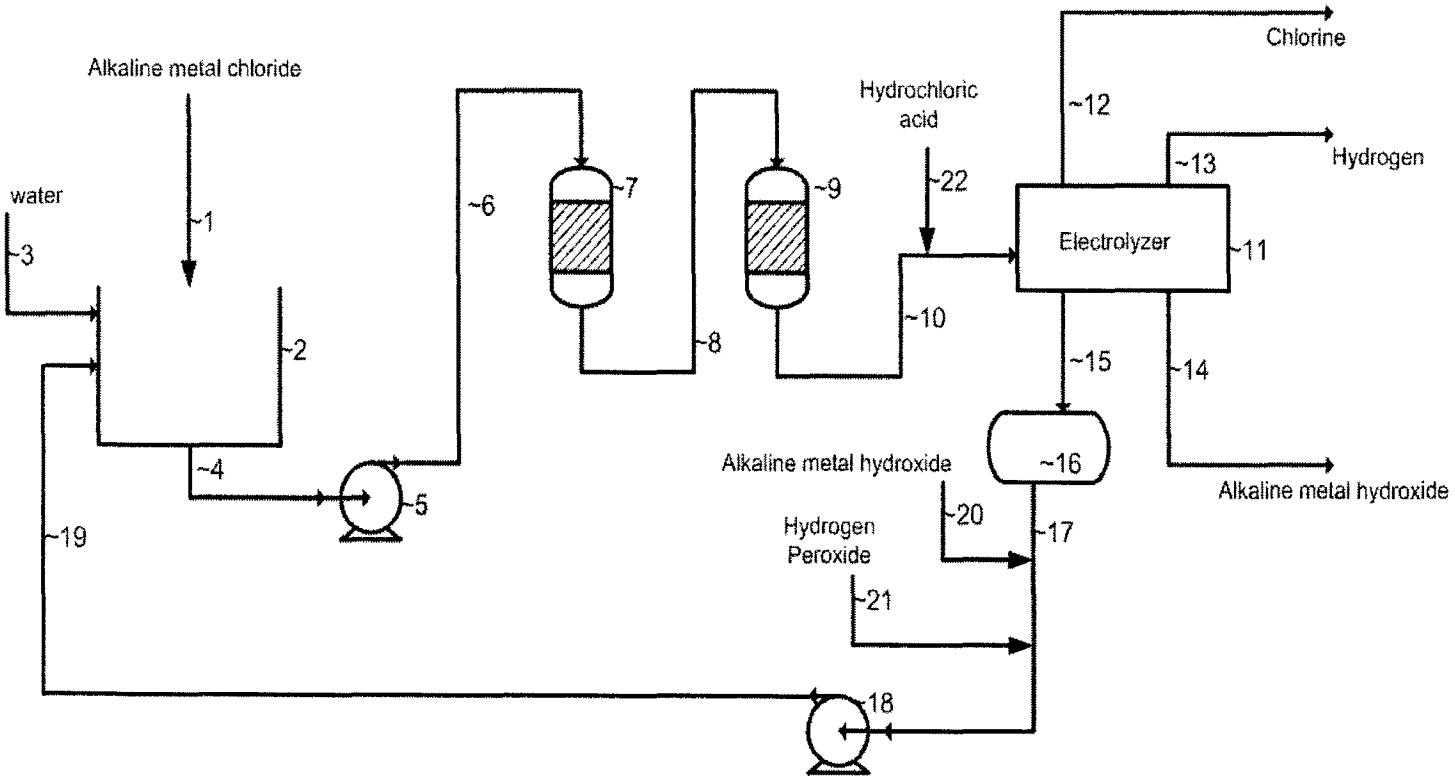
Alkaline metal chloride
1
water
3
2
4
5
6
7
8
9
Hydrochloric acid
22
10
Chlorine
12
Hydrogen
13
11
Electrolyzer
14
Alkaline metal hydroxide
15
16
17
Alkaline metal hydroxide
20
Hydrogen Peroxide
21
18
19

PROCESS FOR PRODUCING CHLORINE, CAUSTIC SODA, AND HYDROGEN

REFERENCE TO RELATED APPLICATION(S)

This application is the U.S. National Phase of PCT/EP2009/067016 filed on Dec. 14, 2009, and claims the benefit of U.S. Provisional Application No. 61/145,348 filed on Jan. 16, 2009.

The present invention relates to a process for producing chlorine, alkaline metal hydroxide, and hydrogen, and a device for carrying out such a process.

The production of chlorine is as such well known. Chlorine can be produced by electrolysis of a sodium chloride solution (brine), with sodium hydroxide and hydrogen being produced as co-products. In another known process chlorine is produced by the electrolysis of a solution of potassium chloride, with caustic potash (potassium hydroxide) and hydrogen being produced as co-products. Such chlorine production processes are normally carried out in large-scale chlorine production plants and have the drawbacks that they involve a large number of process steps, the use of many pieces of equipment, much management attention, and frequent maintenance. In this respect it is observed that a typical large-scale chlorine plant consists of separate blocks for the storage and handling of salt; the production and treatment of brine; multiple steps to remove alkaline precipitants from the brine; multiple operations of electrolysis cells; chlorine cooling and drying steps; chlorine compression and liquefaction steps; the storage and loading, distribution of liquid chlorine; handling, evaporation, storage, loading, and distribution of alkaline metal hydroxide; and treatment, handling, compression, storage, loading, and distribution of hydrogen.

U.S. Pat. No. 4,190,505 for example relates to a process for the electrolysis of sodium chloride containing an iron cyanide complex in an electrolytic cell divided into an anode chamber and a cathode chamber by a cation exchange membrane and using sodium chloride containing an iron cyanide complex as starting material. The iron cyanide complex is removed via an oxidative decomposition step wherein any oxidizing agent generally known in the art can be used, including, for example, chlorine, sodium hypochlorite, hydrogen peroxide, sodium chlorate, potassium chromate, and potassium permanganate. Chlorine and/or sodium hypochlorite are most preferred. The patent discloses a flow sheet of a typical apparatus comprising an electrolytic cell with a cathode chamber and a catholyte tank, with an aqueous caustic soda solution being circulated between said cathode chamber and the catholyte tank. In said catholyte tank, the catholyte is separated into aqueous caustic solution and hydrogen. Anolyte is circulated between the anode chamber and the anolyte tank. Chlorine gas separated from the anolyte is withdrawn and the aqueous sodium chloride solution with decreased concentration is passed to a dechlorination tower. Supplementary water is added to dilute aqueous sodium chloride solution taken from the dechlorination tower. Said diluted solution is then fed to a sodium chloride dissolving tank. The saturated aqueous sodium chloride solution is pre-heated by passing through a heat-exchanger and further heated in an oxidative decomposition tank to 60° C. or higher with steam. After being cooled, the solution is passed to a reaction vessel, where it is treated with additives such as sodium carbonate, caustic soda, etc. The treated solution is then passed successively through a filter and a chelate resin tower wherein calcium ions, magnesium ions, iron ions or others remaining dissolved in the aqueous sodium chloride solution are removed to reduce their contents to 0.1 ppm. The thus purified substantially saturated aqueous sodium chloride solution is fed into the anolyte tank.

The process and device according to U.S. Pat. No. 4,190,505 are examples of a process and device which are complicated and require many pieces of equipment. Hence, much management attention and frequent maintenance is required.

In addition to the complexity of such large-scale production processes, it is noted that a substantial part of the produced chlorine needs to be transported by pipeline, train or truck. Such transports by train and truck are nowadays under discussion in view of related safety and security issues. Hence, there is a clear demand for small-scale chlorine production plants which can produce chlorine for local use. In this respect it is noted that currently existing small-scale chlorine production plants include small mercury-based chlorine production plants, which plants need to be converted or closed in the foreseeable future because of related health and environmental concerns.

Conventional membrane electrolysis chlorine production processes which are normally carried out in large-scale chlorine production plants (production of about 100,000 to 200,000 tons of chlorine per year) could, in theory, be performed on small scale so as to merely satisfy local demand. However, as just explained, such processes require the use of many pieces of equipment, much management attention, and frequent maintenance. Hence, if for example only about 5,000-20,000 tons of chlorine are to be produced per year, it will be difficult to make such processes profitable.

An object of the present invention is therefore to provide a process for the production of chlorine which is economically feasible when carried out in a small-scale, preferably on-site, chlorine production plant. A further object of the present invention is to provide a device for carrying out the process according to the present invention which is automated to such an extent that it can be operated by remote control, so that very little local attention and support is required.

Surprisingly, it has now been found that the first object is realized when use is made of a particular sequence of process steps, so that a simple process is obtained which is suitable to be carried out by remote control.

Accordingly, the present invention relates to a process for producing chlorine, alkaline metal hydroxide, and hydrogen, which process comprises the following steps:

(a) preparing a brine by dissolving an alkaline metal chloride source in water;
(b) removing alkaline precipitates from the brine prepared in step (a) in the presence of hydrogen peroxide or in the presence of at most 5 mg/l of active chlorine by means of a filter of active carbon, and recovering the resulting brine;
(c) subjecting at least part of the resulting brine as obtained in step (b) to an ion-exchange step;
(d) subjecting at least part of the brine as obtained in step (c) to a membrane electrolysis step;
(e) recovering at least part of the chlorine, alkaline metal hydroxide, hydrogen, and brine as obtained in step (d);
(f) subjecting at least part of the brine as obtained in step (d) to a dechlorination step which is carried out in the presence of hydrogen peroxide; and
(g) recycling at least part of the dechlorinated brine obtained in step (f) to step (a).

The process according to the present invention has the advantages that it can deal adequately with transport concerns and does not use mercury, while at the same time it requires fewer process steps, fewer pieces of equipment, lower pressures, less management attention, and less maintenance when compared with conventional chlorine production processes. Thus, with the present invention, an efficient chlorine production process is obtained which is economically feasible, even when performed on small scale. Therefore, the present invention constitutes a considerable improvement over the known processes to produce chlorine. Preferably, the alkaline metal chloride is sodium chloride or potassium chloride. More preferably, the alkaline metal chloride is sodium chloride.

Suitably, step (a) is carried out in a vessel or container containing the alkaline metal chloride source to which vessel or container water is added. The container can, for instance, be a concrete container onto which a plastic cover has been applied. The brine obtained in the vessel or container is then withdrawn from the vessel and subjected to step b). In other words, in accordance with the present invention the salt storage is integrated into the salt dissolver, whereas in the known processes the salt storage and the dissolving of the salt normally take place in separate blocks. It is noted that the term "alkaline metal chloride source" as used throughout this document is meant to denominate all salt sources of which more than 95 wt % is an alkaline metal chloride. Suitably, such salt contains more than 99 wt % by weight of the alkaline metal chloride. Preferably, the salt contains more than 99.5 wt % by weight of the alkaline metal chloride, while a salt containing more than 99.9 wt % of alkaline metal chloride is more preferred (with the weight percentages being based upon dry alkaline metal chloride content, as there will always be traces of water present). Even more preferably, the alkaline metal chloride source is a high purity alkaline metal chloride, and most preferably high purity vacuum sodium chloride or another sodium chloride source of similar purity.

Preferably, the alkaline metal chloride source does not comprise an iron cyanide complex such as potassium ferrocyanide, potassium ferricyanide, sodium ferrocyanide, sodium ferricyanide, because it might have a negative influence on the energy consumption of the electrolysis process. However, if such an iron cyanide complex were to be present in the alkaline metal chloride source, it would not be oxidized with active chlorine, since the active chlorine would already have been removed before it could come into contact with the iron cyanide complex.

The brine as prepared in step (a) preferably contains at least 200 g/l of alkaline metal chloride. More preferably, the brine contains 300-310 g/l of alkaline metal chloride, and most preferably the brine is a saturated alkaline metal chloride solution. Step (a) can suitably be carried out at a temperature of at most 80° C. On the other hand, the temperature in step (a) can suitably be at least ambient temperature. Preferably, step (a) is carried out at a temperature in the range of from 20-80° C. Generally, step (a) will be carried out at atmospheric pressure, although higher pressures can be applied, as will be clear to the skilled person. It is noted that the alkaline metal chloride source is preferably chosen such that it is not necessary to carry out a conventional brine purification step on the brine prepared in step (a), such as for instance described in U.S. Pat. No. 4,242,185, prior to subjecting it to step (b). In other words, preferably, in the present invention a brine purification step wherein the brine is mixed with conventionally used brine purification chemicals, such as for example phosphoric acid, alkali carbonates, alkali bicarbonates, alkali phosphates, alkali acid phosphates or mixtures thereof, is absent.

In step (b) the temperature can suitably be at most 80° C. On the other hand, the temperature can be at least 20° C. Preferably, step (b) is carried out at a temperature in the range of from 20-80° C. The pressure in step (b) is suitably at least 2 bara, and preferably at least 4 bara. On the other hand, the pressure in step (b) is suitably at most 10 bara, preferably at most 6 bara. In step (b) the pressure is preferably in the range of from 2-10 bara, more preferably in the range of from 4-8 bara. In step (b) alkaline precipitates are removed from the brine as prepared in step (a) in the presence of hydrogen peroxide or in the presence of at most 5 mg/l of active chlorine by means of a filter of active carbon, and the resulting brine is recovered. In accordance with the invention the amount of alkaline metal ions can be reduced considerably from that in the brine produced in step (a). Such alkaline precipitates include for instance iron hydroxide, alumina hydroxide, magnesium hydroxide, and other metal hydroxides. The amount of $Fe^{3+}$ present in the brine can be reduced in step (b) to an amount in the range of from 10-200 microgram/I, whereas the amount of $Mg^{2+}$ present in the brine can be reduced in step (b) to an amount in the range of from 300-1,000 microgram/I. In step (b) a filter of active carbon is also used to chemically decompose and/or remove traces of hydrogen peroxide and/or to remove traces of chlorine that are still present in the brine after step (f). In this way, the ion-exchanger to be used in step (c) can suitably be protected. In this respect it is observed that in the known processes such traces are removed by the use of a sequence of two conventional filters which are made of for instance pre-coat type or membrane type. Carbon filters are sometimes used in chlorine production processes. In U.S. Pat. No. 4,242,185, for example, it is described that activated carbon or activated charcoal can be used to destroy residual chlorine in a depleted brine recycle stream. However, surprisingly it was found that when used in accordance with the present invention, the carbon filter also considerably reduces the amount of alkaline metal ions from that in the brine produced in step (a).

Suitably, any filter of active carbon can be used in accordance with the present invention. Preferably, the active carbon to be used can be an acid washed coal-based granular activated carbon or an activated carbon provided with an enhanced catalytic activity to ensure that the hydrogen peroxide and, optionally, any active chlorine are completely decomposed and cannot affect the ion-exchange resin used in step (c). Suitably, the amount of brine that can be passed through the filter per hour is in the range of 1-30 filter volume/hour, preferably in the range of from 8-15 filter volume/hour.

It is noted that it a physical dechlorination step (e.g. using a dechlorination tower) tends not to be used in the process according to the present invention.

In step (c) an ion-exchange step is carried out to decrease the amount of alkaline earth metals present in the brine to ppb level. The amount of $M^{2+}$ ions (M=metal), such as $Ca^{2+}$ and $Mg^{2+}$ ions, can be reduced to a level in the range of 0-20 ppb, while the amount of strontium ions can be reduced to a level of smaller than 50 ppb. Suitably, in the ion-exchange step use is made of two or more ion-exchange columns, which ion-exchange columns can be used in turns. In said columns use can be made of known ion-exchange resins, preferably ion-exchange chelating resins such as for instance Lewatit® TP208 or Amberlite® IRC748. Suitably, the amount of brine that can be passed through each of the ion-exchange columns is in the range of from 10-40 column volume/hour, preferably 15-30 column volume/hour. The temperature in step (c) can suitably be at most 80° C. On the other hand, step (c) can suitably be carried out at a temperature of at least 20° C. Preferably, step (c) is carried out at a temperature in the range of from 20-80° C. Suitably, step (c) can be carried out at a pressure of at most 8 bara, preferably at most 5 bara, more preferably at most 3.5 bara. On the other hand, step (c) can suitably be carried out at a pressure of at least 1 bara, preferably at least 2.5 bara. Preferably, step (c) is carried out at a pressure in the range of from 1-5 bara, more preferably in the range of from 2.5-3.5 bara.

In step (d) at least part of the brine obtained in step (c) is subjected to a membrane electrolysis step in which step chlorine, alkaline metal hydroxide, and hydrogen are formed. The transport of the brine from step (a) through step (d) can advantageously be realized with only one pump. Between step (c) and (step (d) hydrochloric acid is preferably added to the brine obtained in step (c). The membrane electrolysis step in accordance with the present invention is suitably carried out using only one electrolyzer instead of two or more electrolyzers as is the case in conventional chlorine production processes. The electrolyzer to be used in step (d) can be any type of electrolyzer that is usually used in a membrane electrolyzing step. A suitable electrolyzer has, for instance, been described in EP1766104 (A1). Step (d) is suitably carried out at a temperature of at most 95° C., preferably at most 90° C. On the other hand, step (d) is suitably carried out at a temperature of at least 50° C., preferably at least 85° C. Preferably, step (d) is carried out at a temperature in the range of from 50-95° C., preferably at a temperature in the range of from 80-90° C. Suitably, step (d) is carried out at a pressure of at most 2 bara, preferably at most 1.5 bara. On the other hand, step (b) is suitably carried out at a pressure of at least 1 bara, Preferably, step (d) is carried out at a pressure in the range of from 1-2 bara, preferably at a pressure in the range of from 1.0-1.5 bara.

In step (e) of the process of the present invention at least part of the chlorine, alkaline metal hydroxide, hydrogen, and brine as obtained in step (d) is recovered. Preferably, most of the chlorine, alkaline metal hydroxide, hydrogen as obtained in step (d) is recovered in step (e). For this purpose the electrolysis unit to be used in step (d) will comprise an outlet for chlorine, an outlet for alkaline metal hydroxide, an outlet for hydrogen, and an outlet for brine.

At least part of the brine as recovered in step (e) is subjected to a dechlorination step. Preferably, most of the brine, and more preferably all the brine as recovered in step (e) is subjected to dechlorination step (f). Preferably, the dechlorination step is a chemical dechlorination step which is carried out by means of hydrogen peroxide. Preferably, in addition to the hydrogen peroxide also an alkali metal chloride solution (brine) is added to the brine which is recovered in step (e). Step (f) in accordance with the present invention has the advantage that the dechlorination can be carried out using only a chemical dechlorination step, whereas in the known chlorine production processes both a physical and a chemical dechlorination step are required. In the known processes the removal of chlorine from the brine is normally done in two stages, e.g. in the first step by a vacuum dechlorination or air stripping step and subsequently by a chemical dechlorination step wherein usually sodium sulfite or sodium bi-sulfite is applied. The sodium sulfite or bi-sulfite, however, has the disadvantage that it reacts with chlorine to sodium chloride and sodium sulfate, which sodium sulfate subsequently needs to be physically removed from the brine, for instance by means of nano-filtration processes followed by purging and/or precipitation of the sodium sulfate. The brine to be dechlorinated in step (f) suitably contains 200 g/l of sodium chloride, preferably at most 220 g/l of sodium chloride. On the other hand, the brine to be dechlorinated in step (f) suitably contains at least 160 g/l of sodium chloride, preferably at least 200 g/l of sodium chloride. In step (f) the brine to be dechlorinated preferably contains 160-240 g/l of sodium chloride, and more preferably 200-220 g/l of sodium chloride.

Step (f) is suitably carried out at a temperature of at most 95° C., preferably at most 90° C. On the other hand, step (f) is suitably carried out at a temperature of at least 50° C., preferably at least 85° C. Preferably, step (f) is carried out at a temperature in the range of from 50-95° C., more preferably at a temperature in the range of from 85-90° C. Suitably, step (f) is carried out at a pressure of at most 3-6 bara, preferably at most 2.5 bara. On the other hand, step (f) is suitably carried out at a pressure of at least 1 bara, preferably at least 1.2 bara. Preferably, step (d) is carried out at a pressure in the range of from 1-3 bara, more preferably at a pressure in the range of from 1.2-2.5 bara.

In the process according to the present invention at least part of the dechlorinated brine obtained in step (f) is recycled in step (g) to step (a). Preferably, more than 50% of the dechlorinated brine obtained in step (f) is recycled in step (g) to step (a). More preferably, all dechlorinated brine obtained in step (f) is recycled in step (g) to step (a).

In a preferred embodiment of the present invention hydrogen peroxide is used in such an amount in the dechlorination step that the brine which is recycled in step (g) comprises at most 5 mg of hydrogen peroxide per liter of said brine, more preferably at most 3 mg of hydrogen peroxide per liter of said brine, and most preferably at most 1 mg of hydrogen peroxide per liter of said brine. In another preferred embodiment of the present invention, hydrogen peroxide is used in the dechlorination step in such an amount that the brine which is recycled in step (g) comprises at most 5 mg of active chlorine per liter of said brine, more preferably at most 3 mg of active chlorine per liter of said brine, and most preferably at most 1 mg of active chlorine per liter of said brine (with active chlorine expressing the total concentration of chlorine-based oxidants present in the solution).

The process according to the present invention has the major advantage that it can be carried out using remote control, enabling management time and attention to be reduced considerably. Hence, the present process is preferably carried out using remote control. Furthermore, this process is suitable for being carried out on a small scale. Hence, the process is typically performed in a small-scale chlorine plant having a maximum capacity of between 3,000-20,000 metric tons of chlorine per year, preferably between 10,000-17,000 metric tons of chlorine per year.

Surprisingly, it has now been found that the second objective is realized when use is made of a specific device which is remote controlled.

The present invention therefore also relates to a computer-controlled device for carrying out the process according to the invention comprising a vessel for containing an alkaline metal chloride source (2); a filter unit which communicates with the vessel (7); an ion-exchange unit which communicates with the filter unit (9); an electrolysis unit which communicates with the ion-exchange unit (11), the electrolysis unit being provided with an outlet for chlorine (12), an outlet for alkaline metal hydroxide (14), an outlet for hydrogen (13), and an outlet for brine (15); a first pump for transporting the brine from the vessel to the electrolysis unit (5); optionally, a second pump for transporting the dechlorinated brine from the electrolysis unit to the vessel (18); one or more of said units being equipped with one or more sensors for monitoring one or more process parameters such as temperature, pressure, voltage, or current, said sensors being interconnected with one or more first computers, said first computers being linked to one or more second computers in a control room via a communication network, said control room being remote from the electrolysis unit. Said first computer(s) is/are (a) computer(s) which take(s) care of the control and safeguarding of the device. Preferably, said first computer(s) is/are placed in close proximity of the electrolyzer, i.e. in the same location as the device. Said second computer(s), via which the process parameters can be analyzed and monitored and the process according to the present invention controlled, preferably by one or more qualified chlorine operators, is/are placed in a control room which is remote from the device. The control room can be remote from the device (i.e. the electrolysis plant), but still on the same production site as the device. However, in a preferred embodiment, the control room is at a different site which can be located in the same country, but also in another country or even on another continent. Preferably, the control room is on the site of a large conventional electrolysis plant. In this manner, the plant can be controlled and monitored by qualified chlorine operators, thus assuring a smooth and reliable supply of chlorine at the location where the chlorine is needed. The communication network through which the first and second computer(s) are linked can for instance be the Internet. Alternatively, the communication network can be an extranet or an intranet.

Said sensors on said units (i.e. the filter unit, the ion-exchange unit, and/or said electrolysis unit) are part of a monitoring system conventionally used in the art for monitoring the performance of an electrolysis plant. A suitable monitoring system has, for instance, been described in U.S. Pat. No. 6,591,199.

Vessel (2) and/or electrolyzer (11) are preferably equipped with at least one camera and density measurement equipment to monitor the performance of step (a). Said camera(s) and density measurement equipment are preferably also interconnected to said first computer(s) and subsequently linked via a communication network to said second computer(s) in the remote control room. The computer-controlled device for carrying out the process according to the present invention preferably is a small-scale chlorine plant having a maximum capacity of between 3,000-20,000 metric tons of chlorine per year, more preferably between 10,000-17,000 metric tons of chlorine per year. Said device preferably is as compact as possible. It is noted that the device according to the present invention most preferably does not comprise a unit for physical dechlorination (e.g. a dechlorination tower).

In FIG. 1, it is schematically shown how the process of the present invention is carried out.

Via a conduit (1) an alkaline metal chloride is introduced and stored in a vessel (2), and the alkaline metal chloride is dissolved by means of water which is introduced into the vessel (2) by means of a conduit (3) and/or depleted brine which is introduced into the vessel (2) by means of a conduit (19). The salt is preferably introduced into vessel (2) directly from a truck, rail car or conveyor belt. The brine so obtained is withdrawn from vessel (2) via a discharge conduit (4) and passed to a pump (5) for transporting the brine via a conduit (6) to a first active carbon filter (7). The brine obtained from the first carbon filter (7) is then passed via a conduit (8) to the ion-exchange columns (9), after which the brine is introduced into an electrolyzer (11) via a conduit (10). To the brine in conduit (10) hydrochloric acid is added via a conduit (22). In the electrolyzer the brine is converted into chlorine, hydrogen, an alkaline metal chloride solution, and a depleted alkaline metal chloride solution. At least part of the chlorine obtained in the electrolyzer (11) is recovered via a conduit (12), at least part of the hydrogen obtained is recovered via a conduit (13), and at least part of the alkaline metal hydroxide is recovered via a conduit (14). The depleted alkaline metal chloride solution obtained is withdrawn from the electrolyzer (11) by means of a conduit (15) and introduced/stored in a vessel (16). From the vessel (16) a stream of the depleted alkaline metal chloride solution is then passed via a conduit (17), optionally via a pump (18) for transporting the depleted alkaline metal chloride solution via a conduit (19), to the vessel (2). The pump (18) is not compulsory. It is also possible, and in fact preferred, to pass a stream of depleted alkaline metal chloride solution from the electrolyzer (11) via a conduit (17) to the vessel (2) by means of gravity. To the brine in the conduit (17) an alkaline metal hydroxide is added via a conduit (20) and hydrogen peroxide via a conduit (21) in order to establish the chemical dechlorination of the brine. The vessel (2), the carbon filter (also denoted as filter unit) (7), the ion-exchange columns (also denoted as ion-exchange unit) (9), the electrolyzer (also denoted as electrolysis unit) (11), and/or the vessel (16) are equipped with one or more sensors for monitoring one or more process parameters such as temperature, pressure, voltage, or current. Said sensors are interconnected with one or more first computers, and said first computers are linked to one or more second computers in a control room via a communication network, with said control room being remote from the electrolysis unit.

The computer-controlled device for carrying out the process according to the present invention has the advantage that it is compact, since a couple of process steps which are performed in conventional electrolysis processes have been eliminated or are now performed in simpler equipment.

The invention claimed is:

1. A process for producing chlorine, alkaline metal hydroxide, and hydrogen, the process comprising, (a) preparing a brine by dissolving an alkaline metal chloride source in water;

(b) removing alkaline precipitates from the brine prepared in (a) in the presence of hydrogen peroxide or in the presence of at most 5 mg/l of active chlorine with a filter of active carbon;

(c) subjecting at least part of the brine produced in (b) to ion-exchange;

(d) subjecting at least part of the brine produced in (c) to membrane electrolysis;

(e) subjecting at least part of the brine produced in (d) to chemical dechlorination with hydrogen peroxide; and (f) recycling at least part of the dechlorinated brine produced in (e) to the brine of (a).

2. The process according to claim 1, wherein (a) is carried out in a vessel containing the alkaline metal chloride source to which water is added, and the brine so obtained is then withdrawn from the vessel.

3. The process according to claim 1, wherein the brine as prepared in (a) is a saturated sodium chloride solution.

4. The process according to claim 3, wherein (a) is carried out at a temperature range of from 20-80° C.

5. The process according to claim 1, wherein (a) is carried out at a temperature in the range of from 20-80° C.

6. The process according to claim 5, wherein (b) is carried out at a temperature in the range of from 20-80° C. and at a pressure in the range of from 1-10 bara.

7. The process according to claim 5, wherein (c) is carried out at a temperature in the range of from 20-80° C. and at a pressure in the range of from 1-10 bara.

8. The process according to claim 1, wherein (b) is carried out at a temperature in the range of from 20-80° C. and at a pressure in the range of from 1-10 bara.

9. The process according to claim 8, wherein (c) is carried out at a temperature in the range of from 20-80° C. and at a pressure in the range of from 1-10 bara.

10. The process according to claim 8, wherein (d) is carried out at a temperature in the range of from 80-90° C. and at a pressure in the range of from 1.0 to 2 bara.

11. The process according to claim 1, wherein (c) is carried out at a temperature in the range of from 20-80° C. and at a pressure in the range of from 1-10 bara.

12. The process according to claim 11, wherein (d) is carried out at a temperature in the range of from 80-90° C. and at a pressure in the range of from 1.0 to 2 bara.

13. The process according to claim 1, wherein (d) is carried out at a temperature in the range of from 80-90° C. and at a pressure in the range of from 1.0 to 2 bara.

14. The process according to claim 7, wherein (e) is carried out at a temperature in the range of from 80-90° C. and at a pressure in the range of from 1-3 bara.

15. The process according to claim 1, wherein (e) is carried out at a temperature in the range of from 80-90° C. and at a pressure in the range of from 1-3 bara.

16. The process according to claim 15, wherein the brine in (e) contains 170-240 g/l of alkaline metal chloride.

17. The process according to claim 1, wherein the brine in (e) contains 170-240 g/l of alkaline metal chloride.

18. The process according to claim 1, wherein the alkaline metal chloride is sodium chloride and the alkaline metal hydroxide is sodium hydroxide, or the alkaline metal chloride is potassium chloride and the alkaline metal hydroxide is caustic potash.

* * * * *